US009226070B2

(12) United States Patent
Hyun

(10) Patent No.: US 9,226,070 B2
(45) Date of Patent: Dec. 29, 2015

(54) DIRECTIONAL SOUND SOURCE FILTERING APPARATUS USING MICROPHONE ARRAY AND CONTROL METHOD THEREOF

(75) Inventor: Kyung Hak Hyun, Suwon (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 1035 days.

(21) Appl. No.: 13/373,300

(22) Filed: Nov. 10, 2011

(65) Prior Publication Data

US 2012/0163624 A1 Jun. 28, 2012

(30) Foreign Application Priority Data

Dec. 23, 2010 (KR) ..... 10-2010-0133002

(51) Int. Cl.
*H04R 3/00* (2006.01)

(52) U.S. Cl.
CPC ..... *H04R 3/005* (2013.01)

(58) Field of Classification Search
CPC ..... G01S 3/80; G01S 3/801; G01S 3/8055; G01S 5/22; H04R 1/406; H04R 3/005; H04R 2201/401; H04R 2201/403
USPC ..... 700/94; 381/92, 122; 348/14.08
See application file for complete search history.

(56) References Cited

U.S. PATENT DOCUMENTS

| | | | | |
|---|---|---|---|---|
| 2006/0104458 | A1* | 5/2006 | Kenoyer et al. | 381/92 |
| 2007/0211022 | A1* | 9/2007 | Boillot | 345/156 |
| 2010/0110232 | A1 | 5/2010 | Zhang et al. | |
| 2010/0315905 | A1* | 12/2010 | Lee et al. | 367/127 |
| 2012/0124602 | A1* | 5/2012 | Tan et al. | 725/9 |

* cited by examiner

*Primary Examiner* — Simon Sing
*Assistant Examiner* — Eugene Zhao
(74) *Attorney, Agent, or Firm* — Harness, Dickey & Pierce, PLC

(57) ABSTRACT

A directional sound source filtering apparatus using a microphone array and a control method thereof are provided. The directional sound source filtering apparatus using a microphone array includes an image detector to detect images in a destination area, a sound collector located by the microphone array in which microphones are arranged to detect sound sources together with the images detected by the image detector. The apparatus includes a controller to precalculate time delay values of sound sources within the images in order to extract sound sources within the image from the sound sources detected by the sound collector, and perform beamforming through the calculated time delay values. Sound source signals only within images may be selectively amplified using beamformers.

21 Claims, 4 Drawing Sheets

DIRECTIONAL SOUND SOURCE FILTERING APPARATUS USING MICROPHONE ARRAY AND CONTROL METHOD THEREOF

CROSS-REFERENCE TO RELATED APPLICATIONS

This application is related to and claims priority to Korean Patent Application No. 10-2010-0133002, filed on Dec. 23, 2010 in the Korean Intellectual Property Office, the disclosure of which is incorporated herein by reference.

BACKGROUND

1. Field

The embodiments discussed herein are related to a directional sound source filtering apparatus using a microphone array to selectively amplify sound sources by beamforming sound source signals detected by the microphone array, and a control method thereof.

2. Description of the Related Art

Portable devices to make phone calls, recode sound, or capture video have become a necessity of modern life.

Various digital devices, such as consumer electronic devices, cellular phones, and digital camcorders, and in-vehicle speech recognition devices use microphones to capture sound sources.

Sound sources captured using such digital devices may contain noise and interference sound due to a variety of environmental factors.

When capturing audio and video simultaneously through digital devices, only sound sources corresponding to an image area should be amplified for transmission. However, since sound source signals may exhibit strong diffraction, sound sources outside the image area may be combined with sound sources within the image area, causing interference or noise. Therefore, a method and apparatus to collect only sound within an image area while effectively eliminating sound outside the image area are needed.

A method and apparatus have been developed to discern location information of a speaker by recognizing the speaker's face from image information of a camera and to amplify only sound source information obtained from the location information of the speaker. However, this method requires image processing for face recognition, and the image processing performance for face recognition affects the performance of selective amplification of sound sources.

SUMMARY

An aspect of the exemplary embodiment discussed herein relate to providing a directional sound source filtering apparatus using a microphone array to selectively amplify only infield sound source signals detected from a destination area according to viewing angle information of a camera, and a control method thereof.

Additional aspects of the invention will be set forth in part in the description which follows and, in part, will be obvious from the description, or may be learned by practice of the invention.

In accordance with an aspect of the present invention, a directional sound source filtering apparatus using a microphone array includes an image detector to detect images in a destination area, a sound collector located by the microphone array in which a plurality of microphones are arranged to detect sound sources together with the images detected by the image detector, and a controller to precalculate time delay values of sound sources within the images to extract sound sources within the image from the sound sources detected by the sound collector, and perform beamforming through the calculated time delay values.

The controller may include a delay value calculator to set an infield area, which is the destination area, and an outfield area, which is an area except for the infield area, according to a viewing angle of the image detector and precalculate time delay values of sound sources detected from the infield and outfield areas, and a beamforming part to extract sound sources of the infield and outfield areas from the detected sound sources using the calculated time delay values, compensate the extracted sound source signals using the time delay values, and perform frequency conversion.

The delay value calculator may set the infield area, which is located within a viewing angle of the image detector and is an area within the images, and the outfield area, which is an area outside the images.

The delay value calculator may calculate a first delay value, which is a time delay value of the infield area, and a second delay value, which is a time delay value of the outfield area.

The beamforming part may include a first beamformer to beamform sound sources within the infield area by extracting sound sources having the first delay value from the detected sound sources, compensating the extracted sound sources using the first delay value, and performing frequency conversion, and a second beamformer to beamform sound sources within the outfield area by extracting sound sources having the second delay value from the detected sound sources, compensating the extracted sound sources using the second delay value, and performing frequency conversion.

The delay value calculator may set one or more outfield areas according to the arrangement of the plurality of microphones and calculates one or more second delay values corresponding to the set outfield areas.

One or more second beamformers are provided so as to correspond to the set outfield areas.

The controller may further include an operator to detect the sound sources of the infield area beamformed in the first beamformer by eliminating the sound sources beamformed in the second beamformer.

The operator may detect the sound sources only in the infield area by performing an addition operation upon the sound sources beamformed in the first beamformer and performing a subtraction operation upon the sound sources beamformed in the second beamformer.

The controller may further include a filter to eliminate a non-directional noise signal from the sound sources in the infield area detected by the operator.

The filter may be constructed by a least mean square (LMS) filter to eliminate the non-directional noise signal.

The directional sound source filtering apparatus may include an output part to output the images of the destination area and the sound sources detected within the images of the destination area.

In accordance with another aspect of the present invention, a control method of a directional sound source filtering apparatus using a microphone array, wherein the directional sound source filtering apparatus includes an image detector to detect images in a destination area and a sound collector constructed by the microphone array in which a plurality of microphones is arranged to detect sound sources together with the images detected by the image detector, includes precalulating time delay values of sound sources within the images in order to extract sound sources within the images from the sound sources detected by the sound collector, and performing beamforming using the calculated time delay values.

The calculating of the time delay values may include setting an infield area, which is the destination area, and an outfield area, which is an area except for the infield area, according to a viewing angle of the image detector, and pre-calculating time delay values of sound sources detected from the infield and outfield areas.

The setting of the infield and outfield area may include setting the infield area, which is located within a viewing angle of the image detector and is an area within the images, and the outfield area, which is an area outside the images.

The calculating of the time delay values may include calculating a first delay value, which is a time delay value of the infield area, and a second delay value, which is a time delay value of the outfield area.

The performing of the beamforming may include beamforming sound sources within the infield area by extracting sound sources having the first delay value from the detected sound sources, compensating the extracted sound sources using the first delay value, and performing frequency conversion, and beamforming sound sources within the outfield area by extracting sound sources having the second delay value from the detected sound sources, compensating the extracted sound sources using the second delay value, and performing frequency conversion.

The outfield area may be set to at least one or more in number according to the arrangement of the plurality of microphones, and the second delay value is calculated as at least one or more in number so as to correspond to the set outfield areas.

The control method may include detecting the beamformed sound sources only within the infield area by eliminating the beamformed sound sources within the outfield area.

The detecting of the beamformed sound sources only within the infield area may include determining whether sound sources are present within the outfield area, and if the sound sources are present within the outfield area, detecting the sound sources only within the infield area by performing an addition operation upon the sound sources within the infield area and performing a subtraction operation upon the sound sources within the outfield area.

The control method may include eliminating a non-directional noise signal from the detected sound sources within the infield area.

The control method may include outputting the images of the destination area and the sound sources detected within images of the detected destination area.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Exemplary embodiments of a directional sound source filtering apparatus using a microphone array and a control method thereof will now be described with reference to the accompanying drawings.

Figure 1:
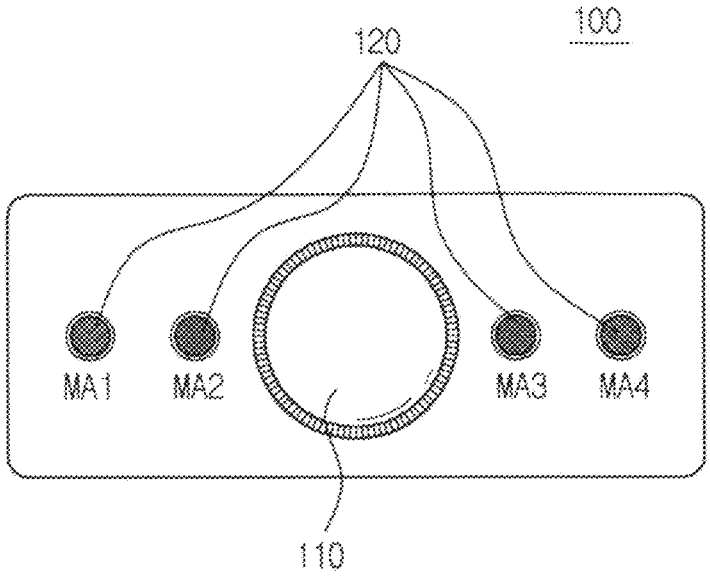
FIG. 1 illustrates a directional sound source filtering apparatus using a microphone array according to an exemplary embodiment of the present invention.

FIG. 1 illustrates a directional sound source filtering apparatus using a microphone array according to an exemplary embodiment of the present invention.

Referring to FIG. 1, a directional sound source filtering apparatus 100 using a microphone array includes an image detector 110 installed, for example, at the front to capture images and a sound collector 120 to collect sound sources of images.

The sound collector 120 includes a microphone array including a plurality of microphones MA1 to MA4 arranged at regular intervals, for example, around the image detector 110.

Although the exemplary embodiment in FIG. 1. illustrates a microphone array including four microphones, a microphone array including less or more than four microphones is included in the scope of the present invention. The exemplary embodiment illustrates a plurality of microphones arranged linearly as the microphone array. However, this arrangement is purely exemplary and a microphone array including only a plurality of microphones may be arranged in a non-linear manner.

The directional sound source filtering apparatus 100 using the microphone array simultaneously collects sound sources and images and amplifies only destination sound sources, which are sound sources within the images, from the collected sound sources. The directional sound source filtering apparatus 100, using the microphone array, filters destination sound sources within an infield area, which is a destination area captured by the image detector 110, using a beamforming technique.

The directional sound source filtering apparatus 100, using the microphone array, may be used for a video phone call, a video conferencing system, etc. so that speaker's voice may be more clearly transmitted.

The directional sound source filtering apparatus using the microphone array to filter only a destination sound source within an infield area will now be described in detail in conjunction with a control block diagram and a circuit diagram thereof.

Figure 2:
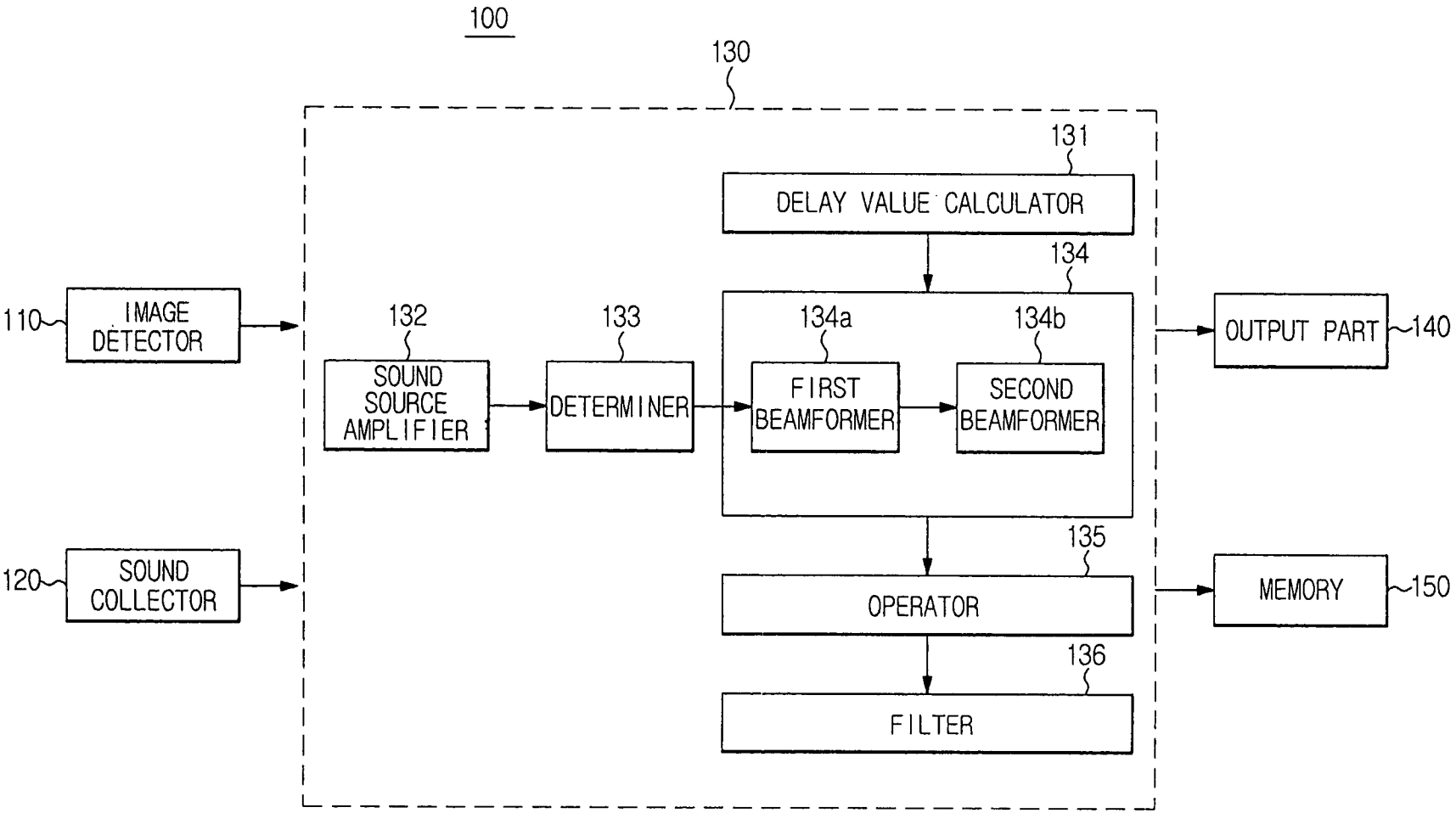
FIG. 2 illustrates a directional sound source filtering apparatus using a microphone array.
Figure 3:
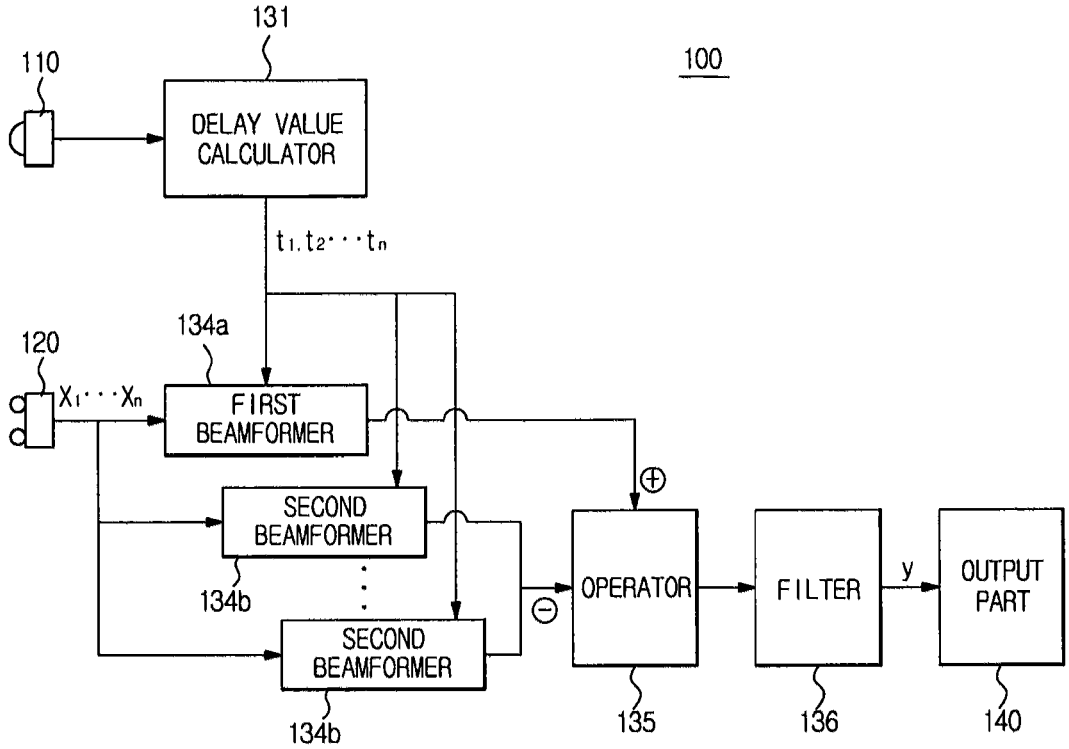
FIG. 3 illustrates a directional sound source filtering apparatus using a microphone array.

FIG. 2 illustrates a directional sound source filtering apparatus, and FIG. 3 is a circuit diagram illustrating a directional sound source filtering apparatus using a microphone array.

The directional sound source filtering apparatus 100 using the microphone array may be fixedly installed in an area to simultaneously collect images and sound sources, for example, in a specific space of a terminal device or a meeting room. The directional sound source filtering apparatus 100 includes an image detector 110, a sound collector 120, a controller 130, an output part 140, and a memory 150.

The image detector 110 is comprised of a camera and collects images in a specific space. The image detector 110 may detect images only in an infield area according to viewing angle information of the camera. That is, the infield area is defined as an area within images collected by the image detector 110.

The sound collector 120 may be comprised of a microphone array. The microphone array detects sound waves of sound sources and generates electric signals corresponding to the sound waves. The generated electric signals may be defined as sound source signals.

The microphone array is comprised of a plurality of microphones. The plurality of microphones may be installed around the image detector 110 at regular or irregular intervals. Information about an interval and location between adjacent microphones is stored in the memory 150 and is used when sound sources are beamformed.

The sound collector 120 detects sound sources, not only in an infield area, but also in an outfield area which is an area outside images, by the microphone array.

The controller 130 generates sound sources only within the infield area using a beamforming technique.

The controller 130 includes a delay value calculator 131, sound source amplifiers 132, a determiner 133, a beamforming part 134, an operator 135, and a filter 136.

The delay value calculator 131 sets the infield area, which is a destination area, and the outfield area, which is a filtering area outside the destination area, using the viewing angle information of the image detector 110 stored previously in the memory 150. The infield area is an area which may be captured by the camera and is predetermined by the viewing angle information of the camera. That is, the infield area is located at the front of the camera and is within a viewing angle area of the camera.

At least one or more outfield areas may be set according to the arrangement of the plurality of microphones. For example, if the plurality of microphones is arranged in a straight line centering on the camera, right outfield areas and left outfield areas may be set. If the plurality of microphones is arranged in a left and right direction and an up and down direction based on the camera, upper and lower outfield areas may be set in addition to the left and right outfield areas.

The delay value calculator 131 calculates time delay values using time information indicating a time for sound sources detected from the infield and outfield areas to reach the sound collector 120.

The delay value calculator 131 calculates a first delay value t1 to compensate the sound source signal detected from the infield area. The delay value calculator 131 also calculates at least one or more second delay values t2, t3, . . . , tn to compensate the sound source signals detected from the at least one or more outfield areas.

The calculated delay values t1, t2, . . . , tn are prestored in the memory 150. The beamforming part 134 beamforms sound sources using the prestored delay values t1, t2, . . . , tn.

The sound source amplifiers 132 are respectively connected to the plurality of microphones of the sound collector 120. The sound source amplifiers 132 and the plurality of microphones may be equal in number. The sound source amplifiers 132 amplify sound source signals transmitted from the plurality of microphones.

The determiner 133 determines whether a specific signal is present among the sound source signals amplified through the sound source amplifiers 132. Upon determining that the specific signal is present, the determiner 133 transmits the specific signal to the beamforming part 134.

The specific signal may be a sound signal. Accordingly, the determiner 133 determines whether a sound signal, frequency range of which is 20 to 20000 Hz audible to the human ear and sound pressure of which is 0 to 130 dB, is present among the sound source signals.

Upon determining that the specific signal is present, the beamforming part 134 beamforms sound source signals detected from a specific direction using the first delay value t1 and the second delay values t2, t3, . . . , tn.

The beamforming part 134 is comprised of delay-and-sum beamformers, and beamforms sound source signals detected from a specific direction.

The delay-and-sum beamformers search for the direction of sound using a time difference of signals reaching the microphones, and boosts sound source signals located only in a specific direction or eliminates unnecessary interference or noise.

Using such a beamforming technique may enhance the capability of speaker localization or sound separation to eliminate or separate noise sources around a speaker and may reduce noise or reverberation, which has no directionality, through post-filtering.

That is, sound source signals in a remote area may be acquired using the microphone array to boost or suppress sound source signals input from a specific direction and to remove sound except for sound source signals in the specific direction.

The beamformers may serve as a spatial filter to filter signals of only a specific area in space.

The beamforming part 134 according to an exemplary embodiment selectively outputs sound source signals existing only in a specific direction using the time delay values t1, t2, . . . , tn, calculated by the delay value calculator 131, corresponding to the infield and outfield areas and eliminates sound source signals existing in other directions.

The beamforming part 134 includes a first beamformer 134*a* to beamform sound source signals in the infield area and a second beamformer 134*b* to beamform sound source signals in the outfield area.

The first beamformer 134*a* outputs sound source signals only within images detected by the image detector 110 and eliminates sound source signals in the other directions.

The second beamformer 134*b* corresponds in number to one or more outfield areas set by the delay value calculator 131. The second beamformer 134*b* outputs sound source signals only within the corresponding outfield areas.

A sound source output process of a beamforming part is disclosed in reference to FIG. 3.

The beamforming part 134 includes a buffer to store sound source signals X1, X2, . . . , Xn transmitted from the sound source amplifiers 132, an extractor to receive the sound source signals X1, X2, . . . , Xn from the buffer and to extract sound source signals having only a specific time delay characteristic, a frequency converter to convert the sound source signals extracted by the extractor into signals in a frequency domain and to divide the sound source signals according to frequencies, and an inverse frequency converter to inversely convert the frequency-converted sound source signals into signals in a time domain.

The first beamformer 134*a* extracts sound source signals having a time delay corresponding to the first delay value t1 from sound source signals, compensates the extracted sound source signals using the first delay value t1, and performs frequency conversion and inverse frequency conversion.

The second beamformer 134*b* extracts sound source signals having time delays corresponding to the second delay values t2, t3, . . . , tn from sound source signals, compensates the extracted sound source signals using the second delay values t2, t3, . . . , tn, and performs frequency conversion and inverse frequency conversion.

Thus, the beamforming part 134 selectively outputs sound source signals detected from a preset direction using time delay information about arrival time of sound source signals and eliminates sound source signals from other directions.

The sound source signals beamformed by the beamforming part 134 are transmitted to the operator 135. The operator 135 extracts sound source signals corresponding only to a specific frequency using spectral subtraction, etc.

The operator 135 may perform an addition operation upon the sound source signals in the first beamformer 134*a* and performs a subtraction operation upon the sound source signals in the second beamformer 134*b*, thereby causing the sound source signals in the first beamformer 134*a* to be output through the output part 140.

As a result of signal processing in the operator 135, sound source signals within the infield area may be boosted and sound source signals within the outfield area may be removed.

The sound source signals within the infield area, generated from the operator 135, are transmitted to the filter 136.

The filter 136 may include a least mean square (LMS) filter, such as a Wiener filter, and eliminates non-directional noise from the sound source signals within the infield area.

Non-directional noise is defined as a signal, strength of which is the same in all directions. Non-directional noise may be low frequency sound such as resonant sound.

The non-directional noise signal has no specific directionality and cannot be beamformed. Accordingly, the non-directional noise signal is eliminated by the filter 136.

The output part 140 outputs sound source signals "y" within the infield area, from which non-directional noise signal has been eliminated, together with the image signals detected by the image detector 110. The output part 140 may be comprised of a display to output the image signals and a speaker to output the sound source signals.

The speaker converts sound source signals, which are generated by performing inverse frequency conversion upon sound source signals "y" within the infield area by the controller 130, into vibration of a vibration plate to output sound waves in the air.

In generating sound signals, the speaker converts the inversely frequency-converted sound signals into vibration of a vibration plate to output sound waves in a way of generating compression and rarefaction waves in the air.

Thus, the noise-eliminated sound signals within an image may be generated together with the image and a ratio of sound source signals within an image area to neighbor noise, that is the performance of the directional sound source filtering apparatus 100 using the microphone array is improved.

Figure 4:
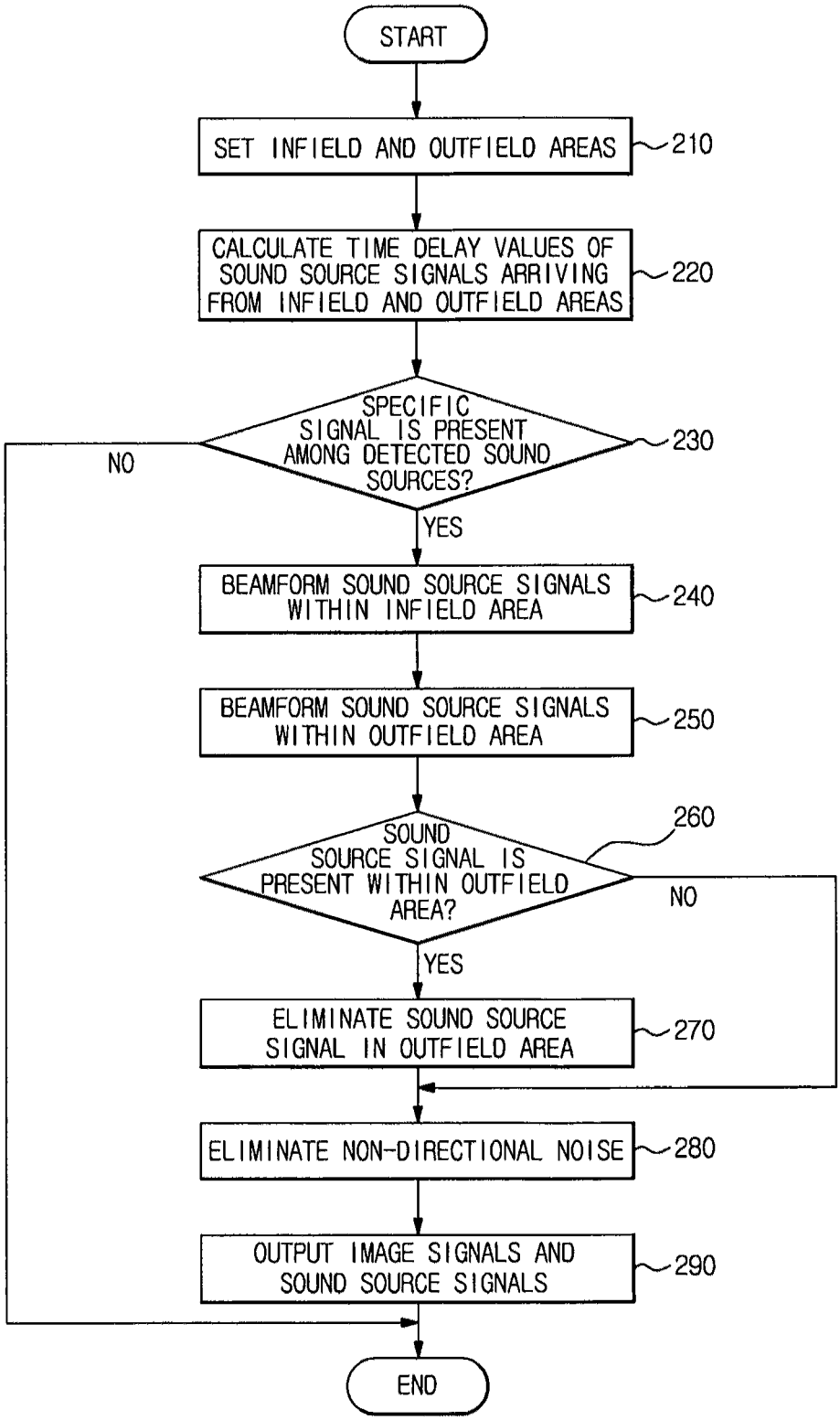
FIG. 4 illustrates a directional sound source filtering method using a microphone array according to an exemplary embodiment of the present invention.

FIG. 4 illustrates a directional sound source filtering method using a microphone array according to an exemplary embodiment of the present invention.

The delay value calculator sets an infield area and an outfield area using previously stored viewing angle information of the image detector in operation 210.

The infield area is a destination area in which an amplified sound source is detected by a directional sound source filtering method using a microphone array according to the exemplary embodiment of the present invention. The infield area is located, for example, at the front of the image detector and is within a view angle area. The infield area is an area within an image detected by the image detector.

The outfield area is an area outside an image detected by the image detector. One or more outfield areas may be set according to the arrangement of a plurality of microphones.

If the infield and outfield areas are set in operation 210, the delay value calculator calculates time delay values of sound source signals arriving from the infield and outfield areas in operation 220.

The delay calculator calculates the time delay values using directionality of sound source signals.

The delay value calculator calculates a first delay value t1 which is a time delay corresponding to the infield area.

The delay value calculator calculates second delay values t2, t3, . . . , tn, which are time delays, corresponding to the at least one or more outfield areas.

The first delay values t1 and the second delay values t2, t3, . . . , tn are transmitted to the beamformer.

The controller of the directional sound source filtering apparatus using the microphone array determines whether a specific signal is present among sound sources detected through the sound collector in operation 230. Upon determining that the specific signal is present, the controller controls the driving of the beamforming part.

The specific signal may be a sound signal. The controller then determines whether a sound signal, frequency range of which is 20 to 20000 Hz audible to the human ear and sound pressure of which is 0 to 130 dB, is present among the sound source signals.

Upon determining that the specific signal is present in operation 230, the beamforming part beamforms sound source signals detected from a specific direction using the first delay value t1 and the second delay values t2, t3, . . . , tn.

The first beamformer outputs sound source signals only within the infield area using the first delay value t1 and eliminates sound source signals in the other directions in operation 240.

The first beamformer extracts sound source signals having the time delay t1 from sound source signals which are detected by the sound source detector comprised of a plurality of microphone arrays and are amplified, compensates the extracted sound source signals using the first delay value t1, performs frequency conversion and inverse frequency conversion, and transmits the converted sound source signals to the operator.

Upon the sound source signals within the infield area being beamformed by the first beamformer in operation 240, the second beamformer beamforms sound source signals within the outfield area in operation 250.

The second beamformer extracts sound source signals having the time delay values t2, t3, . . . , tn from sound source signals which are detected by the sound source detector and are amplified, compensates the extracted sound source signals using the second delay values t2, t3, . . . , tn, performs frequency conversion and inverse frequency conversion, and transmits the converted sound source signals to the operator.

If the sound source signals within the infield and outfield areas are beamformed in steps 240 and 250, the operator determines whether sound source signals are present within the outfield area in operation 260. If the sound source signals within the outfield area are present, the operator eliminates the sound source signals within the outfield area using spectral subtraction etc. in operation 270.

The operator performs an addition operation upon the sound source signals being transmitted from the first beamformer and performs a subtraction operation upon the sound source signals transmitted from the second beamformer, thereby reinforcing sound source signals within the infield area.

The boosted sound source signals within the infield area are transmitted to the filter. The filter eliminates a non-directional noise signal from the sound source signals within the infield area in operation 280.

The filter eliminates a noise signal, for example low frequency sound such as resonant sound, strength of which is the same in all directions and which cannot be beamformed.

The noise-eliminated sound source signals are stored together with the image signals within the infield area detected by the image detector and are transmitted to the output part.

The output part may include a display and a speaker and outputs image signals and sound source signals within the infield area (for example, in operation 290).

Thus, sound signals in an area outside images may be cut off and sound signals only within images are output together with the images.

While a conventional method may discern the location of a speaker by recognizing the speaker's face and output sound signals only in the discerned location, an exemplary embodiment of present invention may selectively amplify sound source signals within images using a plurality of relatively simple beamformers.

Thus, a signal-to-interference ratio (SIR) which is a ratio of sound source signals to noise may be improved.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A directional sound source filtering apparatus using a microphone array, comprising:

an image detector configured to detect images in a destination area;

a sound collector, located by the image detector, comprising the microphone array including a plurality of microphones configured to detect sound sources together with the images detected by the image detector; and a controller configured to precalculate time delay values of the sound sources within the images in order to extract the sound sources within the images from the sound sources detected by the sound collector, and configured to perform beamforming through the calculated time delay values;

wherein the controller includes a delay value calculator configured to set an infield area, which is the destination area, and an outfield area, which is an area except for the infield area, according to a viewing angle of the image detector, and configured to precalculate time delay values of sound sources detected from the infield and outfield areas.

2. The directional sound source filtering apparatus of claim 1, wherein the controller further includes:

a beamforming part configured to extract sound sources of the infield and outfield areas from the detected sound sources using the calculated time delay values, configured to compensate the extracted sound source signals using the time delay values, and configured to perform frequency conversion.

3. The directional sound source filtering apparatus of claim 2, wherein the delay value calculator is configured to set the infield area, which is located within a viewing angle of the image detector and is an area within the images, and the outfield area, which is an area outside the images.

4. The directional sound source filtering apparatus of claim 2, wherein the delay value calculator is configured to calculate a first delay value, which is a time delay value of the infield area, and a second delay value, which is a time delay value of the outfield area.

5. The directional sound source filtering apparatus of claim 4, wherein the beamforming part includes:

a first beamformer configured to beamform sound sources within the infield area by extracting sound sources having the first delay value from the detected sound sources, compensating the extracted sound sources using the first delay value, and performing frequency conversion; and a second beamformer configured to beamform sound sources within the outfield area by extracting sound sources having the second delay value from the detected sound sources, compensating the extracted sound sources using the second delay value, and performing frequency conversion.

6. The directional sound source filtering apparatus of claim 5, wherein the delay value calculator is configured to set at least one or more outfield areas according to the arrangement of the plurality of microphones, and is configured to calculate at least one or more second delay values corresponding to the set outfield areas.

7. The directional sound source filtering apparatus of claim 6, wherein the second beamformer is at least one or more in number so as to correspond to the set outfield areas.

8. The directional sound source filtering apparatus of claim 5, wherein the controller includes an operator configured to detect the sound sources of the infield area beamformed in the first beamformer by eliminating the sound sources beamformed in the second beamformer.

9. The directional sound source filtering apparatus of claim 8, wherein the operator is configured to detect the sound sources only in the infield area by performing an addition operation upon the sound sources beamformed in the first beamformer and performing a subtraction operation upon the sound sources beamformed in the second beamformer.

10. The directional sound source filtering apparatus of claim 8, wherein the controller further includes a filter configured to eliminate a non-directional noise signal from the sound sources in the infield area detected by the operator.

11. The directional sound source filtering apparatus of claim 10, wherein the filter is constructed by a least mean square (LMS) filter to eliminate the non-directional noise signal.

12. The directional sound source filtering apparatus of claim 1, further comprising:

an output part configured to output the images of the destination area and the sound sources detected within the images of the destination area.

13. A control method of a directional sound source filtering apparatus using a microphone array, the directional sound source filtering apparatus including an image detector configured to detect images in a destination area and a sound collector, located by the image detector, comprising the microphone array including a plurality of microphones configured to detect sound sources together with the images detected by the image detector, the control method comprising:

precalculating time delay values of sound sources within the images in order to extract sound sources within the images from the sound sources detected by the sound collector; and performing beamforming using the calculated time delay values;

wherein the precalculating of the time delay values includes:

setting an infield area, which is the destination area, and an outfield area, which is an area except for the infield area, according to a viewing angle of the image detector; and precalculating time delay values of sound sources detected from the infield and outfield areas.

14. The control method of claim 13, wherein the setting of the infield and outfield areas includes setting the infield area, which is located within a viewing angle of the image detector and is an area within the images, and the outfield area, which is an area outside the images.

15. The control method of claim 13, wherein the precalculating of the time delay values includes calculating a first delay value, which is a time delay value of the infield area, and a second delay value, which is a time delay value of the outfield area.

16. The control method of claim 15, wherein the performing of the beamforming includes:

beamforming sound sources within the infield area by extracting sound sources having the first delay value from the detected sound sources, compensating the extracted sound sources using the first delay value, and performing frequency conversion; and beamforming sound sources within the outfield area by extracting sound sources having the second delay value from the detected sound sources, compensating the extracted sound sources using the second delay value, and performing frequency conversion.

17. The control method of claim 16, wherein the outfield area is set to at least one or more in number according to the arrangement of the plurality of microphones, and the second delay value is calculated as at least one or more in number so as to correspond to the set outfield areas.

18. The control method of claim 16, further comprising:

detecting the beamformed sound sources only within the infield area by eliminating the beamformed sound sources within the outfield area.

19. The control method of claim 18, wherein the detecting of the beamformed sound sources only within the infield area includes:

determining whether sound sources are present within the outfield area; and upon the sound sources being present within the outfield area, detecting the sound sources only within the infield area by performing an addition operation upon the sound sources within the infield area and performing a subtraction operation upon the sound sources within the outfield area.

20. The control method of claim 18, further comprising:

eliminating a non-directional noise signal from the detected sound sources within the infield area.

21. The control method of claim 13, further comprising:

outputting the images of the destination area and the sound sources detected within images of the detected destination area.

* * * * *